US007542830B2

(12) United States Patent
Klauder, Jr.

(10) Patent No.: US 7,542,830 B2
(45) Date of Patent: Jun. 2, 2009

(54) METHOD FOR MAINTAINING GEOMETRY OF BALLASTED RAILROAD TRACK

(76) Inventor: Louis T. Klauder, Jr., 833 Galer Dr., Newtown Square, PA (US) 19073

( * ) Notice: Subject to any disclaimer, the term of this patent is extended or adjusted under 35 U.S.C. 154(b) by 250 days.

(21) Appl. No.: 11/587,263

(22) PCT Filed: Apr. 28, 2005

(86) PCT No.: PCT/US2005/014749

§ 371 (c)(1),
(2), (4) Date: Oct. 23, 2006

(87) PCT Pub. No.: WO2005/104789

PCT Pub. Date: Nov. 10, 2005

(65) Prior Publication Data

US 2007/0225877 A1 Sep. 27, 2007

Related U.S. Application Data

(60) Provisional application No. 60/565,666, filed on Apr. 28, 2004.

(51) Int. Cl.
*G05D 1/00* (2006.01)

(52) U.S. Cl. ..... 701/19; 246/33

(58) Field of Classification Search ..... 701/19, 701/20, 201, 207; 246/26, 33, 34 R, 120
See application file for complete search history.

(56) References Cited

U.S. PATENT DOCUMENTS 3,732,827 A 5/1973 Anderson
3,905,568 A 9/1975 Watanabe et al.
3,939,777 A 2/1976 Moran
4,323,013 A 4/1982 Theurer
4,693,183 A 9/1987 Pötzsch
4,860,666 A 8/1989 Smith
4,915,504 A * 4/1990 Thurston ..... 356/604
5,012,413 A 4/1991 Sroka et al.
5,791,254 A 8/1998 Mares et al.
5,988,519 A 11/1999 Jordie (Continued)

FOREIGN PATENT DOCUMENTS

WO WO01 98938 12/2001

(Continued)

OTHER PUBLICATIONS

Abramowitz, Milton, et al., *Handbook of Mathematical Functions*, National Bureau of Standards, Applied Mathematics Series 55, pp. 773-775, U.S. Gov. Printing Office, Washington, D.C. (1964).

(Continued)

*Primary Examiner*—Gertrude Arthur Jeanglaud

(57) ABSTRACT

This invention includes a method for estimating the shape of a section of railroad track from so-called chord offsets measured along it without prior assumptions about the locations and orientations of arcs and tangents that together could define a shape to which the track might be made to conform. This invention also includes a method for finding a configuration of tangents, arcs, and spirals that are as close as practical to a set of existing points along a section of track and that can define a desired shape for calculating instructions to a track lining machine.

6 Claims, 1 Drawing Sheet o — small circles indicate stations that are labeled a, b, c, d, e, ...

U.S. PATENT DOCUMENTS

| | | | |
|---|---|---|---|
| 6,257,494 | B1 | 7/2001 | Tokuoka et al. |
| 6,347,265 | B1 | 2/2002 | Bidaud |
| 7,027,966 | B2 | 4/2006 | Klauder |
| 2001/0010197 | A1 | 8/2001 | Kassab |

FOREIGN PATENT DOCUMENTS

| | | |
|---|---|---|
| WO | WO03083214 | 10/2003 |
| WO | WO2004097114 | 11/2004 |

OTHER PUBLICATIONS

Ahmadian, Mehdi, "Filtering Effects of Mid-Cord Offset Measurements on Track Geometry Data", Proceedings of the 1999 ASME/IEEE Joint Railroad Conference, pp. 157-161 (1999).

Baluch, Henryk, "Optimation of Transition Length Increase", Rail International, Oct. 1982, pp. 12-19.

Belzer, J., "Geometrics of Spiral Bridge Design", 13th National Meeting of the Association for Computing Machinery, pp. 13-1 to 13-3 (Jun. 1958).

Camp, W.M., *Notes on Track*, pp. 318-321 (1903).

Clark, R., "Rail Flaw Detection: Overview and Needs for Future Developments", NDT & E International, vol. 37, No. 2, Mar. 2004, pp. 111-118.

Davis, D.D., et al., "Field Implementation of Flange Bearing in Crossing Diamonds: the North American Rail Industry is Implementing OWLS Flange-Bearing Frog Crossing Diamonds; TTCI Finds OWLS are Suitable for the Job and has a Close Eye on Their Progress", Railway Track and Structures (Oct. 2004).

Klauder, Louis T., Jr., "The Right Way to Design Track Curve Transition Spirals—Improved Spiral Geometry for High Speed Rail", Annual Conference of the American Railway Engineering and Maintenance of Way Association (AREMA), Dallas, Texas (Sep. 11 to 13, 2000).

Kruegar, H., et al., "Simulation Within the Railroad Environment", Proceedings of the 32nd Conference on Winter Simulation, pp. 1191-1200 (Dec. 2000).

Kufver, Björn, VTI Report 420A, "Mathematical Description of Railway Alignments and Some Preliminary Comparative Studies", Swedish National Road and Transport Research Institute, pp. 1-4, 9-12 and 41-60 (1997).

Presle, Gérard, et al., "Entwicklung und Grundlagen neuer Gleisgeometrie", ZEV + DET Glas. Ann. 122, 9/10, Sep./Oct., pp. 579-586 (1998).

Steenblik, R.A., et al., "Numerical Modeling of the Conformational Transition of a Spiral Focusing Surface", ACM SIGSIM Simulation Digest, Proceedings of the 23rd Annual Symposium on Simulation, pp. 127-134 (Apr. 1990).

Unspecified Author, "The MacPherson Switch and Movable Frog; Canadian Pacific Railway", Engineering News (Feb. 21, 1895).

* cited by examiner

METHOD FOR MAINTAINING GEOMETRY OF BALLASTED RAILROAD TRACK

CROSS-REFERENCE TO RELATED APPLICATION

This application claims the benefit of U.S. Provisional Application No. 60/565,666, filed Apr. 28, 2004.

BACKGROUND OF THE INVENTION

The phrase ballasted railroad track refers to railroad track that consists of steel rails mounted on top of support beams called ties that are perpendicular to the rails and that in turn rest on and are surrounded by a bed of small rocks called ballast. A bed of track ballast tends to change shape with time due to its lack of rigidity, due to settlement of the earth on which it rests, due to strains within the rails, and due to forces applied to the rails by passing railroad vehicles. As a result the shape of the guidance path provided by the rails tends to change and degrade with time, and maintenance needs to be performed from time to time to restore the shape of the rails. Such maintenance work is now normally performed using a large semi-automated tamping machine that is able under computer control to adjust the location of a few ties at a time (and the portions of rail that are attached to those ties) while agitating the ballast so that the ties are easier to move and so that the ballast tends to fill in around the adjusted tie locations. This invention has to do with the way that instructions for controlling the operation of such a tamper are computed.

Prior art relating to tamping ballasted railroad track is extensive. Here attention is limited to methods for calculating the lateral displacements between current and desired locations of points along a track. Such displacements are sometimes referred to as track throws.

Prior calculation of corrections to the horizontal geometry of a section of track was based on calculation of a desired location along the track for the start of each transition from tangent or circular arc to spiral and from spiral to another circular arc or back to tangent. Typically a computer program that an engineer or tamper operator uses for calculation of tamping instructions will analyze recently made measurements of track shape to estimate the locations for those transition points, may allow the engineer or operator to adjust them, and will then calculate tamping instructions aimed at bringing the track shape closer to a form with transition points as specified. See, for example, U.S. Pat. No. 5,012,413, entitled "Railroad track curve lining apparatus and method".

SUMMARY OF THE INVENTION

The method of this invention calculates a target track shape composed of tangents and arcs plus spiral transitions that fit together with both compass bearing and curvature continuous with distance and that together constitute a shape whose lateral displacements from points on the existing track are as small as possible with respect to a selected measure such as the root-mean-square.

The method of this invention also includes calculations to construct the existing shape of the track from so-called chord offset measurements when measurements of the existing track are in terms of such offsets rather than in terms of surveyed coordinates of points along the track with respect to a fixed coordinate system.

DESCRIPTION OF THE PREFERRED EMBODIMENTS

Figure 1:
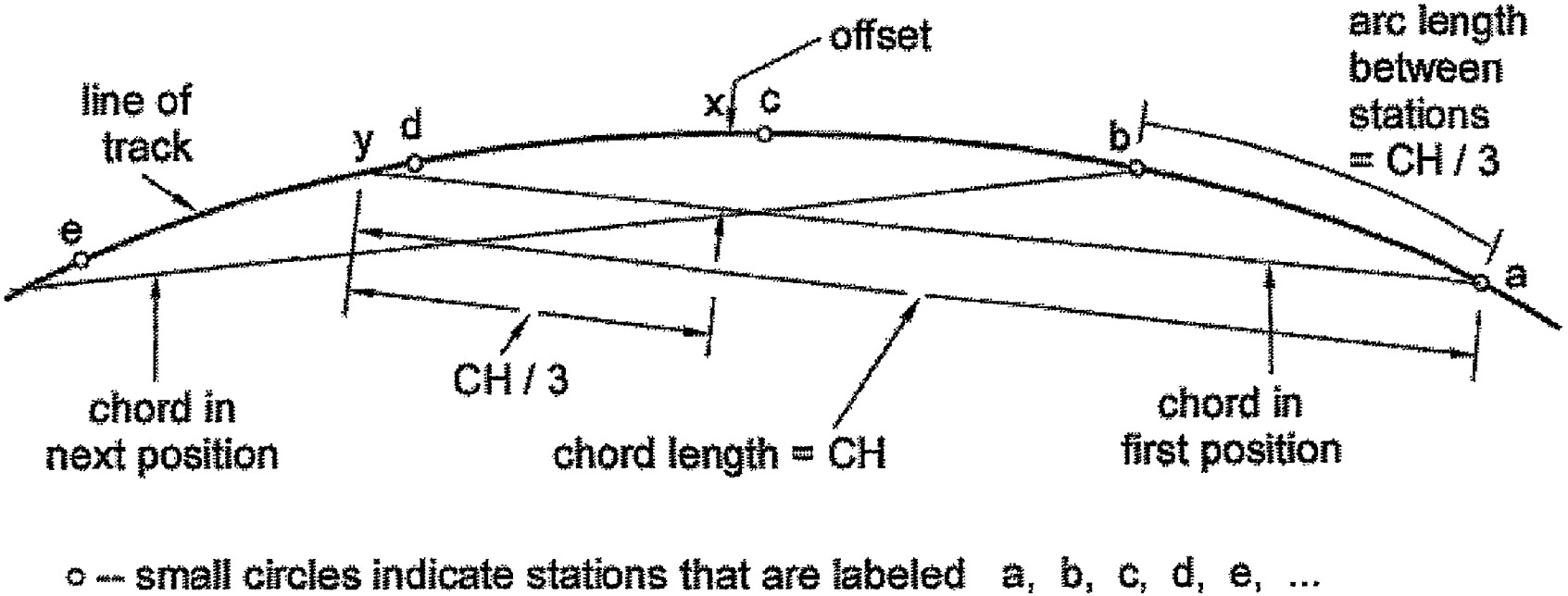
FIG. 1 illustrates a type of extrapolation that can be used to process offsets measured at intervals along an existing track so as to obtain coordinates of points along that track with respect to coordinate axes defined in relation to the track.

1. Obtaining an Estimate of an Existing Track Shape.

For an application in which the existing shape of a section of track is known in terms of measured offsets rather than in terms of surveyed coordinates at points on the track it is necessary to obtain estimates of coordinates of points on the track by processing the offset data. The following paragraphs outline how this estimation can be performed when the distance between track locations at which successive offset measurements are made is close to one sixth the length of the chord used for measuring the offsets. In this case the measured offset values can be separated logically into two sets that are relatively independent of one another. If the distance between track locations at which successive offset measurements are made is close to some other fraction of the length of the chord, then the number of relatively independent sets into which the offset values separate will generally be different, and the details for averaging the results obtained from extrapolations of values of the independent sets are adjusted accordingly.

Referring to FIG. 1, which illustrates half of the offsets, each offset is first modified so that neighboring even and odd offsets have approximately the same average curvature. This is to help minimize the tendency of offset measurement errors to cause points extrapolated from the two independent sets of offsets to become discordant.

Then, extrapolation is initialized by placing point a at an arbitrary point in the xy plane and placing point y so that a main circular arc through points a, x, & y has an arbitrary orientation. Point c is located along that main arc based on arc length from point a along another initializing circular arc through points a, b, & c whose curvature is varied slightly with respect to the curvature of the arc through points a, x, & y and which serves to locate point b in a manner that will be explained. Point b is located midway between points a & c on this other initializing arc. Point d is tentatively located on the main arc an arc distance chord_length/3 beyond point c.

As an illustration of how the extrapolation progresses, the front of the chord is then moved to point b and the chord is rotated so that a new main arc with curvature corresponding to the second offset passes through point y. The location of the back of the chord is recorded, point d is adjusted to be the mean of its tentative location and the point an arc length 2*chord_length/3 beyond point b on the new main arc, and point e is tentatively placed an arc length chord_length past point b on the new main arc.

The above steps are placed inside a loop in which the curvature of the initializing arc governing points b & c is varied in a Newton search procedure to find the positioning of point b such that the disorder of the extrapolated line is minimized. This is necessary because the measured offsets do not give direct information about the placement of point b comparable to the good information that they give about the relative locations of other points within the set.

The above steps are carried out independently for the odd numbered offsets and for the even numbered offsets with a small curvature increment added to all the odd numbered offsets and subtracted from all of the even numbered offsets to further help prevent discord between the two independent sets of point coordinates extrapolated from the even and odd numbered offsets. Then the above steps are repeated inside an iterative search loop that varies both the amount of curvature shifted between sets and the positioning of the points extrapolated from the even numbered offsets relative to the points extrapolated from the odd numbered offsets in order to find the arrangement that minimizes the disorder of all the points taken together.

2. Fitting Target Geometry to an Existing Track Shape

Once the existing track shape is known either via survey or via estimation from measured offsets as exemplified above, the way that this invention determines the target geometry can be illustrated for the case of a single arc bounded by neighboring spirals bounded in turn by sections of tangent track as follows. The target geometry can include either traditional linear spirals or any of the several types of spiral that have been proposed as improvements. The target geometry is then specified by two parameters each for locating the two tangents (for example the compass bearing and depending on the value of the bearing either the x or y intercept) plus three parameters for locating the curve (two to locate the center and one for the radius) so that there are a total of seven parameters to be determined. (A spiral of a specified form is determined by the curvature of the curve and the offset between the curve and the tangent so that a traditional spiral or a simple improved spiral does not offer an additional parameter.) The parameters of the target geometry can be found by a simple Newton type iterative search process in which each parameter is varied to find the configuration that minimizes a measure of the lateral track throws needed to move the track from the existing to the target shape. The foregoing procedure can be extended to cover progressive and reverse curves that include multiple arcs connected by spirals.

Once the target geometry has been calculated the lateral track throw from each extrapolated point on the existing alignment to the corresponding point on the target alignment is obtained by a simple trigonometry and can then be used for calculating instructions to a track lining machine.

It will be understood that various changes in the details which have been herein described and illustrated in order to explain the nature of this invention may be made by those skilled in the art within the principle and scope of the invention as expressed in the following claims.

What is claimed is:

1. A method for processing coordinates of points along an existing track to obtain a desired track alignment defined by a sequence of tangent and circular arc segments and of spirals connecting adjacent segments so that track compass bearing and curvature are continuous throughout whose lateral distances from respective adjacent points on the existing track are minimized, comprising the steps of:

accepting instructions from a user specifying a sequence of tangent and circular arc track segments to be incorporated into a desired track alignment and specifying initial estimates for locations of a beginning and of an end of each tangent and arc segment;

making initial estimates of positioning of tangents and of positioning and radii of arcs by means such as least squares fitting of a tangent or arc to coordinates of points along the existing track that are between the beginning and the end of the tangent or arc segment;

carrying out iterative searching to find a configuration of the tangent and arc segments and connecting spirals so that the tangents, arcs, and spirals taken together are as close as practical to the existing track points based on a measure such as root mean square of transverse distances from adjacent points on the existing track;

adopting the said configuration of tangents, arcs, and spirals as the desired alignment for a corresponding section of track; and calculating instructions directing a track lining machine to adjust the track to conform to said configuration.

2. The method of claim 1 wherein, in the accepting step, a user is assisted by computerlogic that processes the data defining an existing track shape to infer a possible sequence of tangent and arc segments to serve as initial estimates which the user can then accept or modify.

3. A method for processing offset measurements made along an existing track to obtain estimates of coordinates of points along that track that can be processed by the method of claim 1, comprising steps of:

choosing a pair of coordinate axes oriented for convenience to serve as a basis for expressing coordinates of points located along the track by extrapolation from the offset measurements; and applying extrapolation to successive offset measurements with track curvature treated as constant for short distances along the track and thereby placing successive estimated track points relative to the chosen coordinate axes.

4. The method of claim 3 which further includes, for offset measurements which separate naturally into independent sets in the sense that coordinates extrapolated from offsets of one set do not depend on offsets of any other set, the step of applying averaging so that the estimated track coordinates of the various sets are adjusted to minimize the roughness of the resulting estimated track shape.

5. The method of claim 3 which further includes the step of averaging to compensate for an insufficiency of the offset data.

6. The method of claim 5 which further includes, for offset measurements which separate naturally into independent sets in the sense that coordinates extrapolated from offsets of one set do not depend on offsets of any other set, the step of applying averaging so that the estimated track coordinates of the various sets are adjusted to minimize the roughness of the resulting estimated track shape.

* * * * *